US005165129A

United States Patent [19]

Rohm

[11] Patent Number: 5,165,129

[45] Date of Patent: Nov. 24, 1992

[54] ADJUSTABLE BED FRAME WITH INCLINED GUIDE AND DRIVE ELEMENTS

[75] Inventor: Timothy J. Rohm, Gastonia, N.C.

[73] Assignee: Niagara Corporation, Stanley, N.C.

[21] Appl. No.: 661,518

[22] Filed: Feb. 26, 1991

[51] Int. Cl.[5] ..... A61G 7/00

[52] U.S. Cl. ..... 5/613; 5/616; 5/618

[58] Field of Search ..... 5/66–69

[56] References Cited

U.S. PATENT DOCUMENTS

| | | | |
|---|---|---|---|
| 1,573,530 | 2/1926 | Weaver | 5/69 |
| 2,279,307 | 4/1942 | Freund | 5/68 |
| 2,517,466 | 8/1950 | Cox | 5/67 |
| 2,582,565 | 1/1952 | Schnippel et al. . | |
| 2,631,300 | 3/1953 | Murray | 5/69 |
| 3,233,255 | 2/1966 | Propst . | |
| 3,447,170 | 6/1969 | Spitz | 5/68 |
| 3,633,225 | 1/1972 | Burst | 5/68 |
| 3,644,946 | 2/1972 | Swatt | 5/68 |
| 4,277,857 | 7/1981 | Svehaug . | |
| 4,361,917 | 12/1982 | Wilson | 5/69 |
| 4,381,571 | 5/1983 | Elliott . | |
| 4,395,786 | 8/1983 | Casey et al. . | |
| 4,715,073 | 12/1987 | Butler . | |

FOREIGN PATENT DOCUMENTS

| | | | |
|---|---|---|---|
| 146156 | 7/1954 | Sweden | 5/68 |

*Primary Examiner*—Eric K. Nicholson

*Attorney, Agent, or Firm*—Bell, Seltzer, Park & Gibson

[57] ABSTRACT

A frame for an adjustable bed is disclosed and which comprises a body supporting platform composed of a head panel, a center panel, a leg panel, and a foot panel. A base supports the platform, and the base includes a pair of upwardly inclined guide surfaces which are in the form of an inverted V. A U-shaped lift arm is pivotally connected to the head panel and slides along one of the guide surfaces to raise and lower the head panel, and a second U-shaped lift arm is pivotally connected to the leg panel and slides along the other of the guide surfaces to raise and lower the leg panel. A pair of electrical drive motors are provided for separately controlling the sliding movement of each of the lift arms in both directions.

4 Claims, 2 Drawing Sheets

ADJUSTABLE BED FRAME WITH INCLINED GUIDE AND DRIVE ELEMENTS

BACKGROUND OF THE INVENTION

The present invention relates to a frame for an adjustable bed of the type having provision for adjustment of the inclination of either or both of the head portion and foot portion of the bed.

Adjustable beds of the described type have long been recognized as being helpful in relieving muscle tension and fatigue. Also, by permitting the separate adjustment of the inclination of the head portion and the foot portion, the user is able to configure the bed to best meet the individual comfort needs of his or her body. A bed of this general type is illustrated for example in U.S. Pat. No. 4,381,571 to Elliott.

In one known frame for a bed of the described type, an actuating mechanism is provided wherein a drive motor acts to move a lever arm, and the lever arm pivots at a pivot point to raise or lower the head or foot portion of the bed. In another known design, a scissors mechanism is employed for this purpose. While these prior designs are satisfactory in many respects, they are typically unable to reliably support and move the movable portion of the bed against a large resistance, as would be present for example when the bed is used by an overweight person, since the torque to raise or lower the movable portion is transmitted directly through the drive motor.

It is an object of the present invention to provide an adjustable bed frame which avoids the above noted limitations and disadvantages of the existing designs.

It is a more particular object of the present invention to provide an adjustable bed frame wherein the frame utilizes mechanical components for supporting the weight of the user in the raised position of the movable portions, and so that the force of this weight is not transmitted through the drive motor.

It is another object of the present invention to provide a lifting mechanism for an adjustable bed which is smoothly and quietly operable, and which provides assurance to the user of its safe and reliable operation.

It is also an object of the present invention to provide a lifting mechanism for an adjustable bed of the described type and wherein the mechanism self releases in the event of an interference or blockage during its lowering movement, to thereby avoid the risk of serious injury to the occupant or other person resulting from the entrapment of a body member in the components of the mechanism.

It is still another object of the present invention to provide a lifting mechanism for an adjustable bed frame which is of simple and inexpensive construction, and which provides a pleasing aesthetic appearance.

SUMMARY OF THE INVENTION

The above and other objects and advantages of the present invention are achieved in the embodiment illustrated herein by the provision of a frame which comprises a base which is composed of a pair of longitudinally spaced apart foot portions adapted to engage the floor, and an upwardly inclined guide surface extending upwardly and longitudinally from one of the foot portions in a direction generally toward the other foot portion and to an elevated apex portion. A body supporting platform is provided which comprises a head panel, and a center panel which are aligned in the longitudinal direction, and the center panel is fixed to the elevated apex portion of the base in a generally horizontal orientation. Brace means pivotally connects the head panel to the base such that the head panel is on one longitudinal side of the center panel and is pivotal between a lowered position which is coplanar with the center panel, and a raised position which is upwardly inclined from the center panel, and lift means is provided for selectively pivoting the head panel between the lowered and the raised positions. The lift means comprises a lift arm having one end pivotally connected to the head panel and an opposite end slideably engaging the guide surface, and drive means for selectively sliding the opposite end of the lift arm along the guide surface of the base in either direction.

In the preferred embodiment, the base comprises a pair of upwardly inclined guide surfaces extending upwardly and toward each other from respective ones of the foot portions and with the guide surfaces being configured in the general form of an inverted V to define the elevated apex portion. Also, the body supporting platform additionally comprises a leg panel and a foot panel which are aligned in the longitudinal direction with the head panel and center panel. Further, second brace means pivotally connects the leg panel to said base such that the leg panel is on the longitudinal side of the center panel opposite the head panel and is pivotal between a lowered position which is coplanar with the center panel, and a raised position which is upwardly inclined from the center panel, and third brace means pivotally connects the foot panel to the leg panel and to the base such that said leg panel is positioned on the longitudinal side of the leg panel opposite the center panel and remains generally horizontal during pivotal movement of the leg panel. Second lift means is provided for selectively pivoting the leg panel between the lowered and the raised positions, and comprises a second lift arm having one end pivotally connected to the leg panel and an opposite end slideably engaging the other of the guide surfaces, and second drive means for selectively sliding the opposite end of the second lift arm along the other guide surface in either direction.

The base preferably comprises a pair of laterally spaced apart base members, and each of the guide surfaces comprises a pair of laterally spaced apart and coplanar guide surface segments positioned on respective ones of the base members. Also, both the first lift arm and the second lift arm comprises a U-shaped bracket comprising two parallel outer legs and a lateral cross leg interconnected therebetween. The first and second drive means comprises a pair of drive motors with each motor being operatively connected to the cross leg of one of the first and second lift arms.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figures 1, 2, 4:
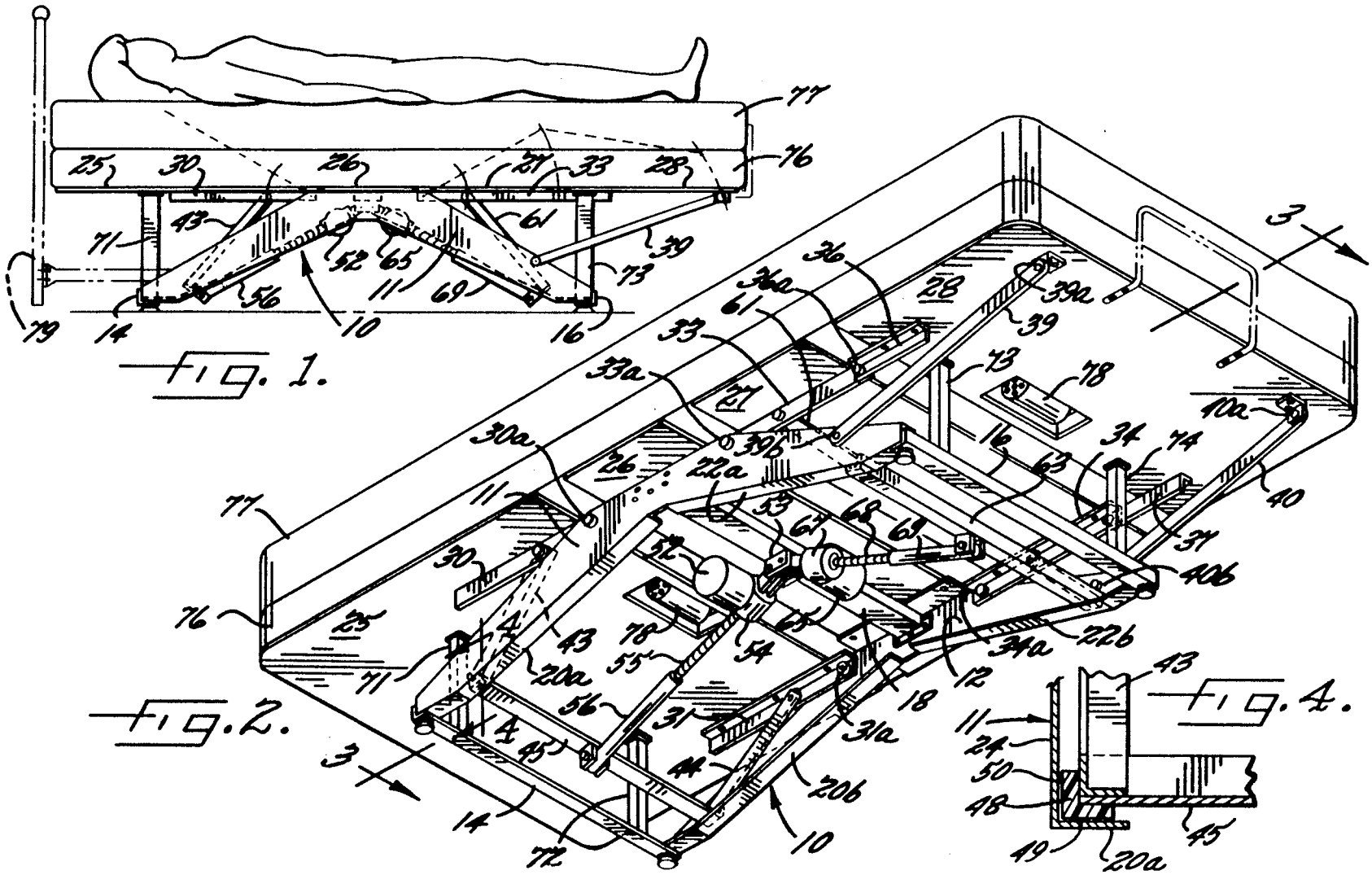
FIG. 1 is a side elevation view of an adjustable bed frame which embodies the features of the present invention.
FIG. 2 is a perspective view of the frame looking upwardly from a position below the frame.
FIG. 4 is a fragmentary sectional view taken substantially along the line 4—4 of FIG. 2.

Referring more particularly to the drawings, an adjustable bed frame is illustrated and which comprises a base which is generally indicated at 10 and which is composed of a pair of laterally spaced apart base members 11, 12. A cross brace 14 interconnects the two base members 11, 12 below the head end of the bed to define a floor engaging foot portion, and a second cross brace 16 interconnects the two base members 11, 12 below the opposite end of the bed to define a second floor engaging foot portion which is longitudinally spaced from the foot portion defined by the brace 14. Also, a cross beam 18 interconnects the two base members 11, 12 below the center of the bed.

The base 10 also defines a pair of upwardly inclined and upwardly facing guide surfaces extending upwardly and toward each other from respective ones of the foot portions, and with the guide surfaces being configured in the general form of an inverted V to define an elevated apex portion. A forward guide surface extends upwardly from the brace 14 and is composed of a pair of laterally spaced apart and coplanar guide surface segments 20*a*, 20*b* positioned on respective ones of the base members 11, 12, and a rear guide surface extends upwardly from the brace 16 and is composed of a pair of laterally spaced apart and coplanar guide surface segments 22*a*, 22*b* positioned on respective ones of the base members 11, 12. Each base member 11, 12 further includes a vertical side plate 24 which extends upwardly from the outside edge of the associated guide surface segment, note FIG. 4.

Figure 3:
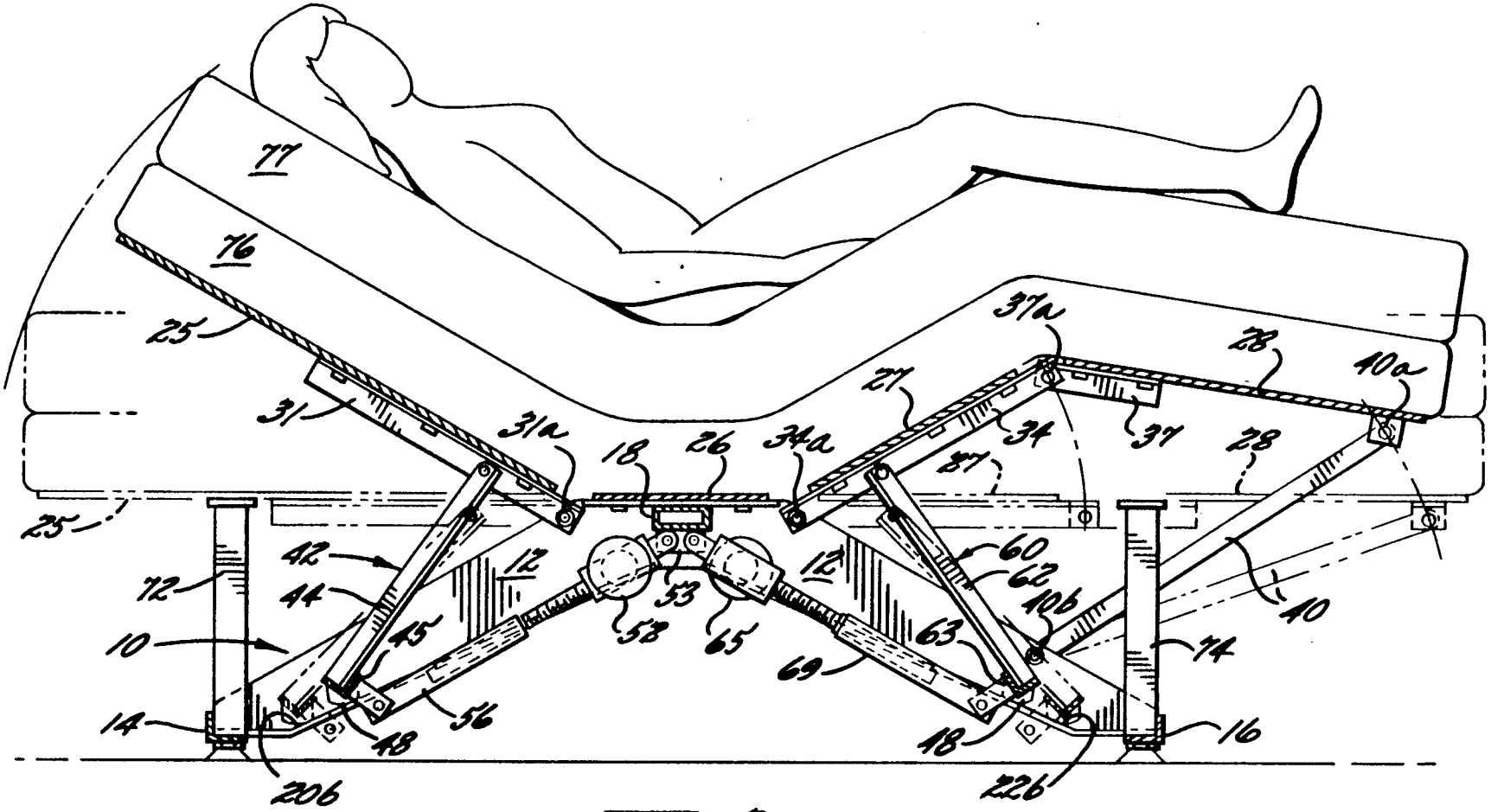
FIG. 3 is a sectional side elevation view taken substantially along the line 3—3 of FIG. 2.

The bed frame further includes a body supporting platform which comprises a head panel 25, a center panel 26, a leg panel 27, and a foot panel 28 which are aligned in the longitudinal direction. As best seen in FIG. 3, the center panel 26 is fixed to the elevated apex portion of the base 10 in a generally horizontal orientation.

First brace means is provided for pivotally connecting the head panel 25 to the base 10 such that the head panel is on one longitudinal side of the center panel 26 and is pivotal between a lowered position as seen in dashed lines in FIG. 3 and which is coplanar with the center panel, and a raised position as seen in solid lines in FIG. 3 and which is upwardly inclined from the center panel. The first brace means comprises a pair of laterally spaced apart brackets 30, 31 which underlie and are fixed to the head panel 25, and which have one end pivotally attached to the base members at 30*a*, 31*a* respectively.

Second brace means is provided for pivotally connecting the leg panel 27 to the base 10 such that the leg panel 27 is on the longitudinal side of the center panel 26 opposite the head panel 25 and is pivotal between a lowered position shown in dashed lines in FIG. 3 and which is coplanar with the center panel 26, and a raised position shown in solid lines in FIG. 3 and which is upwardly inclined from the center panel. The second brace means comprises a pair of laterally spaced apart brackets 33, 34 which underlie and are fixed to the leg panel 27, and which have one end pivotally attached to the base members at 33*a*, 34*a* respectively.

Third brace means is provided for pivotally connecting the foot panel 28 to the leg panel 27 and to the base 10, such that the foot panel 28 is positioned on the longitudinal side of the leg panel 27 opposite the center panel 26 and remains generally horizontal during pivotal movement of the leg panel. More particularly, the foot panel 28 is raised from a lowered position which is coplanar with the leg panel 27 as seen in dashed lines in FIG. 3, to a raised but generally horizontal position as shown in solid lines in FIG. 3. The third brace means comprises a pair of laterally spaced apart brackets 36, 37 which underlie and are fixed to the foot panel 28 and which have one end pivotally attached to the ends the brackets 33, 34 at 36*a*, 37*a* respectively. This permits the foot panel and leg panel to relatively pivot about a lateral pivot axis which extends therebetween. Also, there is provided cooperating brace members 39, 40 each having an upper end pivotally connected to the bottom of the foot panel at 39*a*, 40*a* respectively, and a lower end pivotally attached to respective ones of the base members 11, 12 at 39*b*, 40*b* respectively.

First lift means is provided for selectively pivoting the head panel 25 between the lowered and raised positions, and which comprises a first lift arm 42 which is in the form of a U-shaped bracket comprising two parallel outer legs 43, 44 and a lateral cross leg 45 interconnected therebetween. The outer legs 43, 44 have upper ends which are pivotally connected to the brackets 30, 31 of the head panel, and the cross leg 45 has opposite ends which slidable engage respective ones of the guide surface segments 20*a*, 20*b* of the forward guide surface. To facilitate the sliding movement of the ends of the cross leg along the guide surface segments, a glide 48 of low friction plastic material is mounted to each of the ends of the cross leg 45 as best seen in FIG. 4. The lower surfaces 49 of the glides 48 which contact the guide surface segments 20*a*, 20*b* are arcuately curved as best seen in FIG. 3, so as to permit a slight pivotal movement between the lift arm 42 and the guide surface segments 20*a*, 20*b*. Also, the glides 48 include a lateral edge surface 50 which is spaced a small distance from the vertical side plate 24 of the base members 11, 12, so as to limit lateral movement of the lift arm.

A first drive means is provided for selectively sliding the lateral cross leg 45 of the arm 42 along the guide surface segments 20*a*, 20*b* in either direction. This drive means comprises a reversible electrical drive motor 52 which is pivotally mounted to a bracket 53, which in turn is pivotally connected to the cross beam 18 which extends laterally between the two base members adjacent the central or upper apex portion thereof. The drive motor 52 includes a reduction gear 54 which turns a lead screw 55, which in turn is threaded into a sleeve 56 which is pivotally connected to the cross leg 45.

A second lift means is provided for selectively pivoting the leg panel between its lowered and raised positions. The second lift means comprises a second lift arm 60 in the form of a U-shaped bracket comprising two parallel outer legs 61, 62 and a lateral cross leg 63 interconnected therebetween. The outer legs 61, 62 have upper ends which are pivotally connected to the brackets 33, 34 of the leg panel, and the cross leg 63 has opposite ends which slidable engage respective ones of the guide surface segments 22*a*, 22*b* of the rear guide surface. A glide 48 of the structure described above is mounted to each of the ends of the cross leg 63 for facilitating the sliding movement. Also, there is provided a second reversible electrical drive motor 65 for sliding the second arm 60 in either direction, and the drive motor 63 is pivotally connected to the bracket 53 which is connected to the cross beam 18, and it includes a reduction gear 67 which is operatively connected to a lead screw 68, which is in turn threadedly received into the sleeve 69 which is pivotally connected to the cross leg 63.

The frame further includes a pair of upright posts 71, 72 which are fixed to the cross brace 14, and which limit the downward pivotal movement of the head panel 25. These posts thus support the weight of the user in the lowered position of the head panel. Also, a second pair of upright posts 73, 74 are fixed to the cross brace 16, and the posts 73, 74 serve to limit the downward pivotal movement of the foot panel in its lowered position and to also support some of the weight of the user in the lowered position of the frame.

As is conventional, a mattress is positioned to rest upon the four panels 25–28 of the frame, and the mattress may comprises a separate foundation pad 76 and an upper pad 77 as illustrated. Further, the frame may mount a vibration unit 78 in the head panel and the foot panel, as is conventional, and the frame may also mount a head board 79, as is conventional.

In use, the user of the bed may operate a control unit (not shown) to selectively operate either of the motors 52, 65 in either direction. As will be apparent, during such movement and during use of the bed, the weight of the user is transferred from the head panel 25 through the lift arm 42 directly to the base members 11, 12, and none of the force is transmitted through the motor 52. Similarly, the weight of the user is transferred from the leg panel 27 through the lift arm 62 directly to the base members 11, 12, and none of this force is transmitted through the motor 65. Suitable limit switches may be provided to control the maximum settings of these positions.

In the event an object, such as the limb of the occupant or other person, should accidentally become entrapped in the components of the frame during downward pivotal movement of either the head panel or the leg panel, it will be apparent that the continued operation of the motor will serve to pivot the lift arm 42 or 60 in a direction so as to lift the arm away from the associated guide surface. Thus the force of the motor would not bear against the entrapped object, and the only force exerted would be a portion of the weight of the bed and occupant. The risk of a serious injury is thereby effectively avoided.

In the drawings and specification, there has been set forth a preferred embodiment of the invention, and although specific terms are employed, they are used in a generic and descriptive sense only and not for purposes of limitation.

That which is claimed is:

1. A frame for an adjustable bed or the like and comprising a base comprising a pair of laterally spaced apart base members, a pair of longitudinally spaced apart foot portions mounted to said base members and adapted to engage the floor, and a pair of upwardly inclined guide surfaces extending upwardly and longitudinally toward each other from respective ones of the foot portions and configured in the general form of an inverted V to define an elevated apex portion, with each of said guide surfaces comprising a pair of laterally spaced apart, coplanar, and upwardly open guide surface segments positioned on respective ones of said base members, a body supporting platform comprising a head panel, a center panel, a leg panel, and a foot panel which are aligned in the longitudinal direction, with said center panel being fixed to said elevated apex portion of said base in a generally horizontal orientation, first brace means pivotally connecting said head panel to said base such that said head panel is on one longitudinal side of said center panel and is pivotal between a lowered position which is coplanar with said center panel, and a raised position which is upwardly inclined from said center panel, second brace means pivotally connecting said leg panel to said base such that said leg panel is on the longitudinal side of said center panel opposite said head panel and is pivotal between a lowered position which is coplanar with said center panel, and a raised position which is upwardly inclined from said center panel, third brace means pivotally connecting said foot panel to said leg panel and to said base such that said leg panel is positioned on the longitudinal side of said leg panel opposite said center panel and remains generally horizontal during pivotal movement of said leg panel, first lift means for selectively pivoting said head panel between said lowered and said raised positions, and comprising a first lift arm having one end pivotally connected to said head panel and an opposite end slideably engaging one of said guide surfaces, and first drive means for selectively sliding the opposite end of said first lift arm along said one guide surface in either direction, and with said first lift arm comprising a U-shaped bracket comprising two parallel outer legs and a lateral cross leg interconnected therebetween with said outer legs having outer ends which are pivotally connected to said head panel, and with said cross leg having opposite ends slideably engaging respective ones of said guide surface segments of the associated guide surface, second lift means for selectively pivoting said leg panel between said lowered and said raised positions, and comprising a second lift arm having one end pivotally connected to said leg panel and an opposite end slideably engaging the other of said guide surfaces, and second drive means for selectively sliding the opposite end of said second lift arm along said other guide surface in either direction, and with said second lift arm comprising a U-shaped bracket comprising two parallel outer legs and a lateral cross leg interconnected therebetween, with said outer legs having outer ends which are pivotally connected to said leg panel, and with said cross leg having opposite ends slideably engaging respective ones of said guide surface segments of the associated guide surface, and wherein said first drive means comprises a first drive motor having a first output shaft operatively connected to said cross leg of said first lift arm and extending in a direction generally parallel to the inclined direction of the associated guide surface, and said second drive means comprises a second drive motor having a second output shaft operatively connected to said cross leg of said second lift arm and extending in a direction generally parallel to the inclined direction of the associated guide surface.

2. The frame as defined in claim 1 wherein a glide of low friction plastic material is mounted to each of the ends of each of said cross legs for facilitating the sliding movement thereof.

3. A frame for an adjustable bed or the like and comprising a base comprising a pair of laterally spaced apart base members, a pair of longitudinally spaced apart foot portions mounted to said base members and adapted to engage the floor, and an upwardly inclined guide surface extending upwardly and longitudinally from one of the foot portions in a direction generally toward the other foot portion and to an elevated apex portion, with said guide surface comprising a pair of laterally spaced apart, coplanar, and upwardly open guide surface segments positioned on respective ones of said base members, a body supporting platform comprising a head panel, and a center panel which are aligned in the longitudinal direction, with said center panel being fixed to said elevated apex portion of said base in a generally horizontal orientation, brace means pivotally connecting said head panel to said base such that said head panel is on one longitudinal side of said center panel and is pivotal between a lowered position which is coplanar with said center panel, and a raised position which is upwardly inclined from said center panel, and lift means for selectively pivoting said head panel between said lowered and said raised positions, and comprising a lift arm having one end pivotally connected to said head panel and an opposite end slideably engaging said guide surface, and drive means for selectively sliding the opposite end of said lift arm along said guide surface of said base in either direction, with said lift arm comprising a U-shaped bracket comprising two parallel outer legs and a lateral cross leg interconnected therebetween, with said outer legs having outer ends which are pivotally connected to said head panel, and with said cross leg having opposite ends slideably engaging respective ones of said guide surface segments of said guide surface, and wherein said drive means comprises a drive motor having an output shaft operatively connected to said cross leg of said lift arm and extending in a direction generally parallel to the inclined direction of said guide surface.

4. The frame as defined in claim 3 wherein a glide of low friction plastic material is mounted to each of the ends of said cross leg for facilitating the sliding movement thereof.

* * * * *